United States Patent [19]

Parisien

[11] Patent Number: 4,714,246

[45] Date of Patent: Dec. 22, 1987

[54] EXERCISE DEVICE

[76] Inventor: Pierre A. Parisien, 400 Stewart Ave., #704, Ottawa, Ontario, Canada, K1N 6L2

[21] Appl. No.: 914,317

[22] Filed: Oct. 2, 1986

[51] Int. Cl.[4] ..... A63B 21/06; A63B 59/00; A63B 67/20

[52] U.S. Cl. ..... 272/93; 272/67; 272/117; 273/67 R; 273/330

[58] Field of Search ..... 272/67, 93, 117, 124, 272/143; 273/67 R, 67 B, 319–321, 330

[56] References Cited

U.S. PATENT DOCUMENTS

| | | | |
|---|---|---|---|
| 1,345,241 | 6/1920 | Reynolds | 273/67 R X |
| 2,566,044 | 8/1951 | Trepanier | 273/330 |
| 3,148,883 | 9/1964 | Ruderian | 273/330 |
| 3,414,260 | 12/1968 | Gust | 272/124 |
| 3,721,441 | 3/1973 | Wininger | 273/330 |
| 4,047,717 | 9/1977 | De Angelis | 273/67 R X |
| 4,079,935 | 3/1978 | Gormley | 273/67 R |
| 4,375,890 | 3/1983 | Thomas | 273/320 |
| 4,431,185 | 2/1984 | Cisneros | 272/117 |

*Primary Examiner*—Nancy J. Stodola

[57] ABSTRACT

A disk is provided with two diametrically opposed handles. A resilient ball is tethered to the center of the disk by a flexible, but substantially inelastic line, said line being slightly shorter than the radius of the disk. Weights may be attached to the device. Proper flexions and extensions of the arms or of other parts of the user's body set the ball in a periodic bouncing motion. The rhythm thus established regulates the various exercises of the user.

4 Claims, 6 Drawing Figures

10
24
22
26
18
20
34
16
14
32

28
36
26
34
16
20
14
32
26
32

15
15
2

EXERCISE DEVICE

BACKGROUND OF THE INVENTION

Exercise devices are used for a variety of purposes: to increase the strength and improve the tone of the targeted muscle groups; to increase the bulk of same; to increase the endurance of same; and to increase the endurance and promote the fitness of the body generally, especially the cardiovascular system (heart and lungs). Many devices try to fulfill a combination of these purposes.

In order to achieve their objective, exercise devices perform one or both of two functions: they can offer resistance to bodily movements and they can regulate and motivate such movements. The resistance function is best exemplified by barbells and springs. The regulation-motivation function is exemplified by jump ropes and threadmills.

The resistance function of weights can be intensified by using momentum. This can be done by imparting motion to a mass and changing the velocity or direction of this motion by muscular action. This principle is exemplified by a few exercisers patterned after the "button-on-a-string" toy in which a disk is made to rotate alternately in clockwise and counter-clockwise directions.

SUMMARY

The exercise device of the present invention is designed to fulfill all the aforementioned purposes except, perhaps, muscle bulk increase, and to perform both aforementioned functions. It is also designed to use momentum to increase resistance.

A planar disk is provided with two diametrically opposed handles with hand grips in a tangential orientation. A small resilient ball is tethered to the center of said disk by a flexible, but substantially inelastic line which is slightly shorter than the radius of the disk. Various weights can be attached to the disk. Said weights can be attached individually, or two or more can be attached simultaneously.

Said disk may be made of wood or plastic or other suitable material. The ball may be made of natural or synthetic rubber or of a suitable plastic. Sponge rubber balls of the proper density, such as are used in the paddle game known as *fly-back*, in which the ball is tethered to a paddle by an elastic line, have been found most adequate. The weights can be made of iron or steel. Flat annular weights such as are used in barbells have proven very adequate.

After experimentation with prototypes the following approximate dimensions have been found practical:

the disk:

15 inches in diameter,

⅜ inch in thickness;

the tether:

12 inches long, from disc to ball, and ⅝ inch thick;

the ball:

1¼ inches in diameter.

The diameter and thickness of the weights will vary with their mass. Because of the construction and method of use of the device, heavy weights are not needed. A combined total of ten pounds would be more than sufficient for most users. Of course, these dimensions could be substantially altered without departing from the spirit and scope of the invention.

DESCRIPTION OF THE INVENTION

Figure 2:
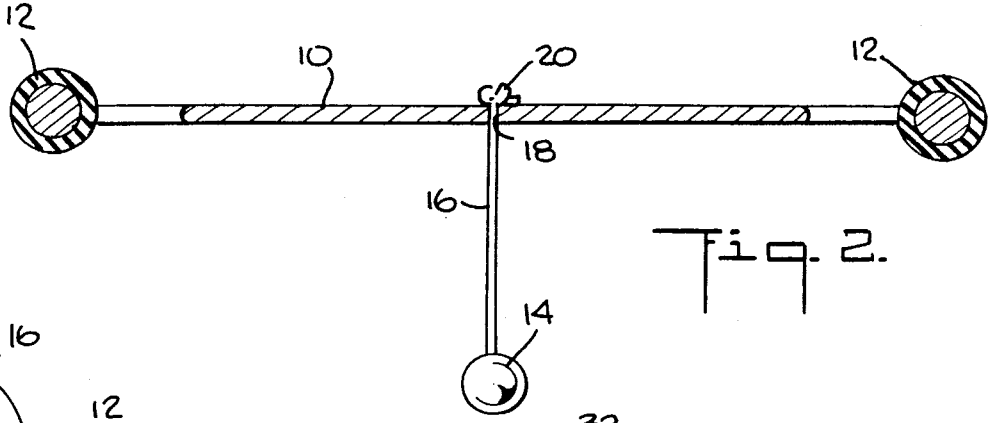
FIG. 2 is a longitudinal cross-section through the handles of an embodiment not using detachable weights.

As shown in the drawings, the planar disk 10 is provided with two diametrically opposed handles 12, the hand grips being tangential to the circumference of said disk. Said handles may be an integral part of disk 10, or separate handles attached to said disk by means of screws, or bolts, or by gluing. The resilient ball 14 is tethered to the center of disk 10 by means of a flexible, but substantially inelastic line 16 which passes through hole 18 and is retained by means of knot 20. Obviously a retaining clasp could be used instead of knot 20.

Figure 3:
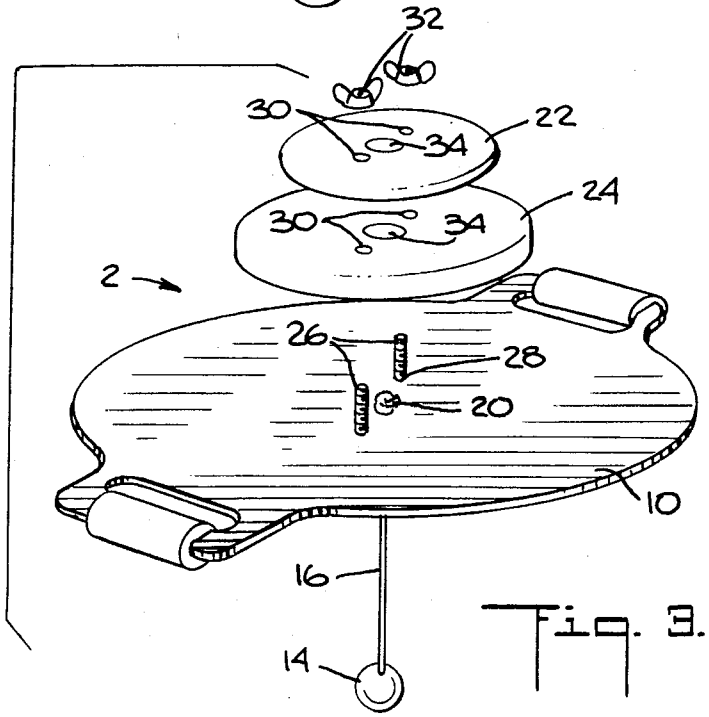
FIG. 3 is an exploded perspective of an embodiment using two detachable weights, both weights being secured on the side of the disk opposite the ball and tether.
Figures 4, 5, 6:
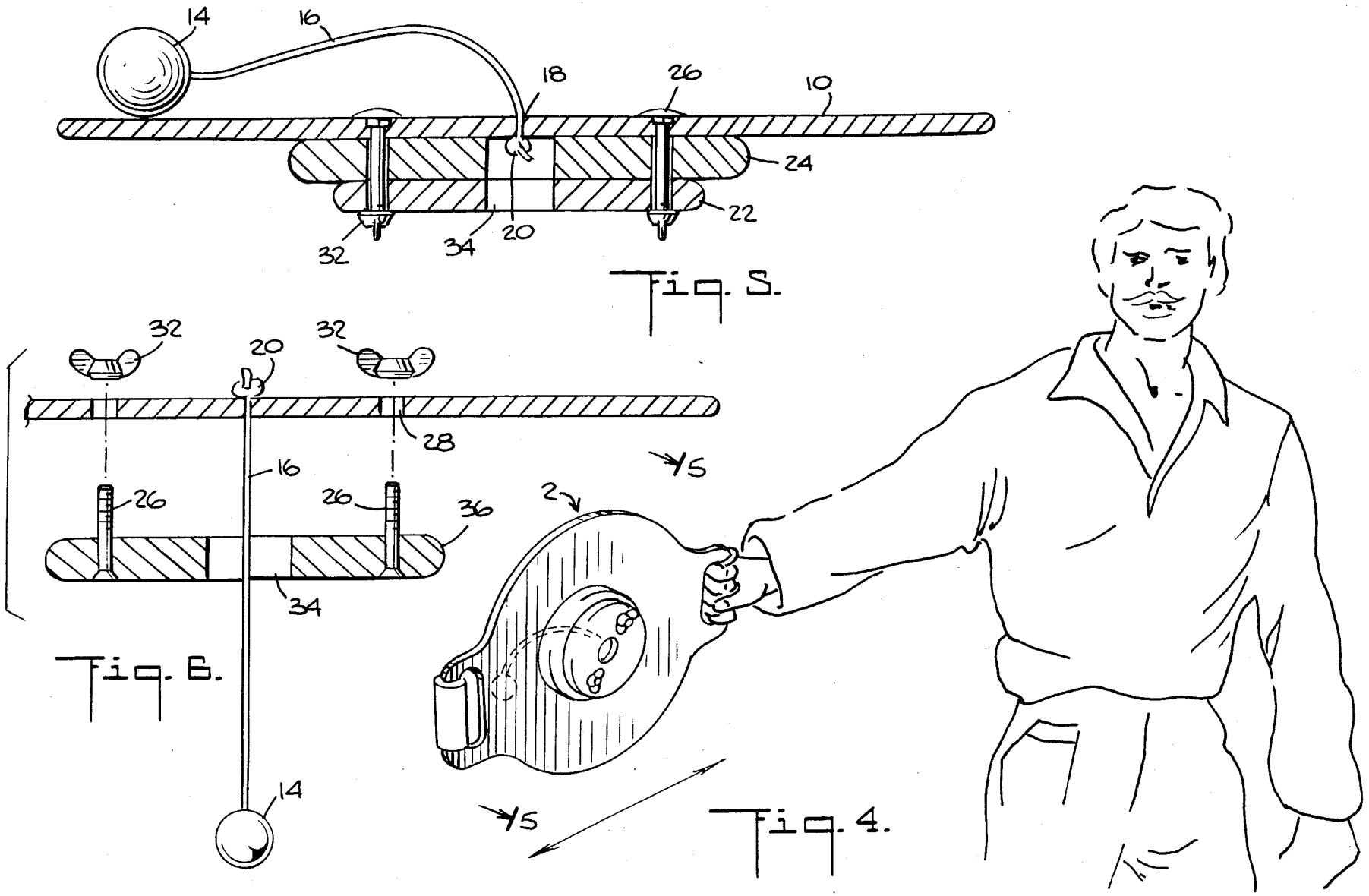
FIG. 4 is a perspective view of the embodiment of FIG. 3 being held with one hand.
FIG. 5 is a cross-section along the line 5—5 of FIG. 4.
FIG. 6 is a cross-section of an embodiment showing one weight secured on the same side as the ball and tether.

FIGS. 3 and 5 show the preferred embodiment of the exercise device. A small weight 22 and a larger weight 24—both of a flat, annular shape—are included in the device. The center holes 34 accomodate knot 20 or other retaining means. Disc 10 is provided with two holes 28 which align with two similar holes 30 in the weights 22 and 24. Two bolts 26 pass through holes 28 and then through holes 30. Nuts 32 firmly attached the weights to the device. Weights 22 and 24 can be interchanged singly or used in combination. Thus the device would have four degrees of gravitational resistance: zero added weights; weight 22 attached singly; weight 24 attached singly; and, finally, weights 22 and 24 attached in combination as in FIG. 5. Of course, the device could be provided with more than two weights.

FIG. 6 shows another embodiment in which a weight 36 is attached to the device 2 on the same side of disk 10 as the ball 14 and tether 16. Additional weights can be attached on the opposite side of disk 10. The advantage of this embodiment is that bolts 26 could be welded to weight 36 thus making the adding and changing of additional weights more convenient.

USE OF THE INVENTION

When the purpose of the exercise routine is to enhance general fitness and promote cardiovascular conditioning, aerobic exercises are performed. The device 2 is held in front of the body with both hands as in FIG. 1. Up and down flexion and extension of the arms as well as general motions of the body impart a vertical periodic motion to ball 14 as indicated by the arrows in FIG. 1. The ball with bounce off disk 10 at the top and bottom of its trajectory. The user can jog; jog-in-place; or perform aerobic calisthenics such as side kicks, front kicks, back kicks, side leg-scissors, front-back leg-scissors and one-legged hops. The rhythm of the ball will provide regulation and motivation for these exercises. The weight of the device will enhance the aerobic benefit as well as provide a measure of toning and strengthening benefits. For an aerobic routine the user would select a total weight appropriate to his strength and conditioning and do the whole routine without further change.

Figure 1:
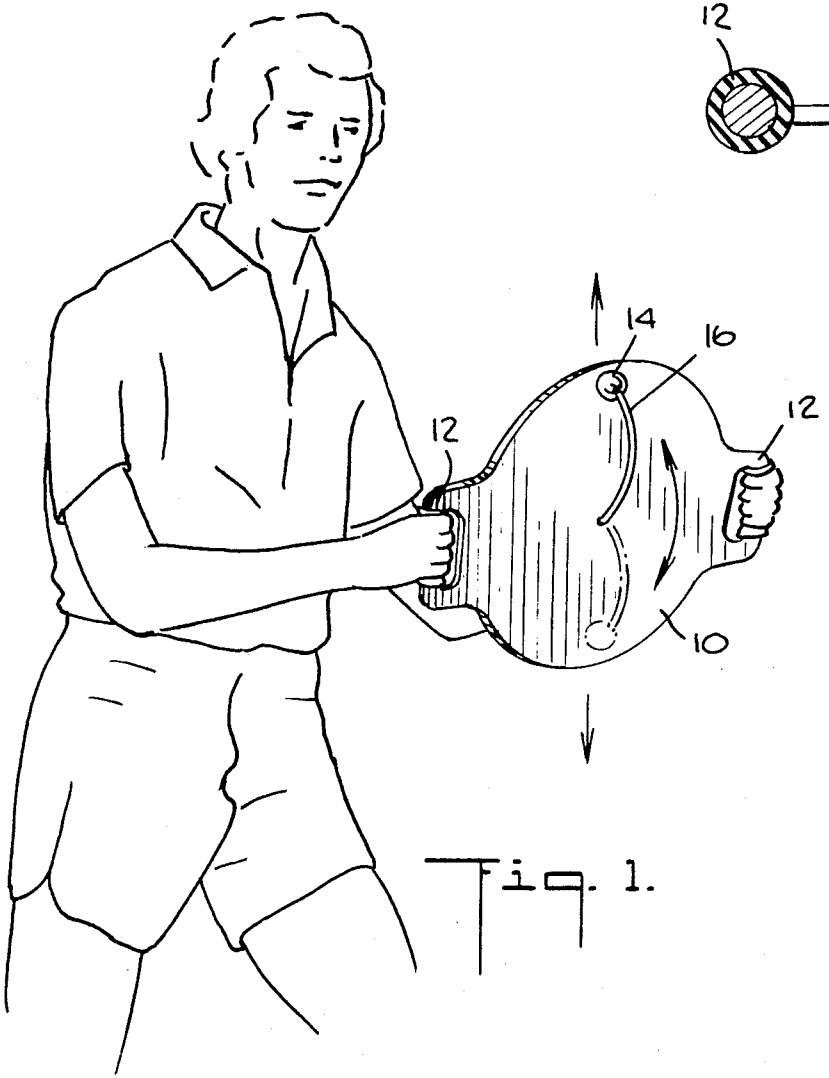
FIG. 1 is a perspective view of the exercise device being held with both hands.

When the purpose of the routine is to increase the strength, tone and endurance of the upper body musculature, the device can be held with both hands as in FIG. 1, or with one hand as in FIG. 4, depending on the specific exercise being performed. The device can be held in front of the body, over the head, at the side with the arm parallel to the ground or at the side with the arm extended downwards. Specific muscle groups are targeted by specific exercises. The weights or combinations thereof might be changed according to the exercise being performed.

Using FIG. 4 as an example: the device is held in the right hand, more-or-less in front of the body, and a jabbing, back-and-forth motion of the arms is repeated. If the exercise is done properly, the ball will bounce back-and-forth in a horizontal trajectory. The motion may be repeated as long as desired. This exercise strengthens the muscles of the shoulder, upper arm, forearm, wrist and hand. The necessity of stopping motion in one direction and immediately starting motion in the opposite direction increases the resistance offered by the mass of the device in accordance with the laws of motion of classical mechanics.

Having described the construction and use of my invention, I claim:

1. An exercise device consisting of a disk provided with two diametrically opposed handles to which disk is tethered at the center a resilient ball, the tether being of flexible but substantially inelastic material and of a length slightly shorter than the radius of said disk, thus allowing the ball to bounce back and forth against said disk, said ball being free to move in any direction and to strike said disk at any point of contact within the limits imposed by the length of said tether.

2. An exercise device as described in claim 1 wherein one or more weights can be removably attached to the disk.

3. An exercise device as described in claim 2, wherein the weights are of a flat annular shape and are provided with two or more small holes in alignment with two or more similar holes in the disk of said device so as to permit attachment of said weights to said disk by means of nuts and bolts and wherein said weights are attached on the side of the disk opposite the side to which the ball and tether are attached.

4. An exercise device as described in claim 3 wherein one of the weights is attached to the side of the disk to which the ball and tether are attached and any additional weights are attached on the opposite side.

* * * * *